US011584404B2

(12) United States Patent
Ring et al.

(10) Patent No.: US 11,584,404 B2
(45) Date of Patent: Feb. 21, 2023

(54) SELECTIVE CUSHION UNIT YOKE WITH INTEGRAL DRAFT GEAR HOUSING

(71) Applicant: Strato, Inc., Piscataway, NJ (US)

(72) Inventors: Michael Ring, Lake Village, IN (US); Jonathan Sunde, Somerset, NJ (US)

(73) Assignee: Strato, Inc.

( * ) Notice: Subject to any disclaimer, the term of this patent is extended or adjusted under 35 U.S.C. 154(b) by 418 days.

(21) Appl. No.: 16/774,290

(22) Filed: Jan. 28, 2020

(65) Prior Publication Data

US 2021/0229712 A1 Jul. 29, 2021

(51) Int. Cl.

| | |
|---|---|
| ***B61G 9/04*** | (2006.01) |
| ***B61G 9/06*** | (2006.01) |
| ***B61G 9/22*** | (2006.01) |

(52) U.S. Cl.

CPC ..... *B61G 9/06* (2013.01); *B61G 9/04* (2013.01); *B61G 9/22* (2013.01)

(58) Field of Classification Search

CPC ... B61G 9/04; B61G 9/06; B61G 9/10; B61G 9/22

USPC ..... 213/40 R, 45, 75 R

See application file for complete search history.

(56) References Cited

U.S. PATENT DOCUMENTS

| | | | | |
|---|---|---|---|---|
| 2,469,126 | A | 5/1949 | Munro et al. | |
| 2,559,743 | A | 7/1951 | Williams | |
| 2,706,050 | A | 4/1955 | Sprouse | |
| 2,728,465 | A | 12/1955 | Campbell | |
| 2,766,894 | A | 10/1956 | Campbell | |
| 2,825,472 | A | 3/1958 | Peterson | |
| 2,970,703 | A | 2/1961 | Blattner | |
| 3,197,037 | A | 7/1965 | Willison | |
| 3,370,718 | A | 2/1968 | Waddell | |
| 3,622,015 | A | 11/1971 | Atkinson et al. | |
| 3,712,479 | A | 1/1973 | Atkinson | |
| 3,800,961 | A | 4/1974 | Hawthorne | |
| 3,827,575 | A | 8/1974 | Mosier et al. | |
| 3,838,778 | A | 10/1974 | Appleton | |
| 5,312,007 | A * | 5/1994 | Kaufhold | B61G 7/10 213/50 |
| 5,487,480 | A | 1/1996 | Page et al. | |
| 6,360,906 | B1 | 3/2002 | Kaufhold et al. | |
| 6,446,820 | B1 | 9/2002 | Barker et al. | |
| 6,681,943 | B2 | 1/2004 | Barker et al. | |
| 8,590,717 | B2 | 11/2013 | Wilt et al. | |

(Continued)

FOREIGN PATENT DOCUMENTS

| | | |
|---|---|---|
| GB | 919899 | 2/1963 |

OTHER PUBLICATIONS

International Search Report and Written Opinion of corresponding PCT application No. PCT/US19/63837 dated Feb. 18, 2020.

(Continued)

*Primary Examiner* — Zachary L Kuhfuss

(74) *Attorney, Agent, or Firm* — AP Patents; Alexander Pokot

(57) ABSTRACT

A cushioning apparatus for a railway car employs a shortened yoke having a draft gear housing integral with the yoke. A stack elastomeric pads is provided in the housing, and a second stack of elastomeric pads and corresponding rigid metal plates, is positioned in the sill behind the modified yoke to absorb buff loads on the coupler. In embodiments, the entire assembly may be placed in a sill having forward stops, intermediate stops, and rear stops.

30 Claims, 7 Drawing Sheets

(56) References Cited

U.S. PATENT DOCUMENTS

| | | | |
|---|---|---|---|
| 8,870,002 | B2 | 10/2014 | Wilt et al. |
| 8,939,300 | B2 | 1/2015 | Wilt et al. |
| 8,985,355 | B2 | 3/2015 | Wilt |
| 9,056,618 | B2 | 6/2015 | Gagliardino et al. |
| D781,179 | S | 3/2017 | Schoedl et al. |
| 9,598,092 | B2 | 3/2017 | James et al. |
| 9,669,848 | B2 | 6/2017 | Creighton et al. |
| 9,789,888 | B2 | 10/2017 | Wilt et al. |
| 9,868,453 | B2 | 1/2018 | Johnson et al. |
| 10,011,288 | B2 | 7/2018 | Gagliardino et al. |
| 10,086,852 | B2 | 10/2018 | Iler |
| 10,308,263 | B1 | 6/2019 | Ring et al. |
| 10,513,042 | B2 | 12/2019 | Ring et al. |
| 2002/0070189 | A1 | 6/2002 | Barker et al. |
| 2006/0043044 | A1 | 3/2006 | Ring et al. |
| 2008/0008225 | A1 | 1/2008 | Ahmad et al. |
| 2008/0011700 | A1 | 1/2008 | Brough et al. |
| 2013/0270210 | A1 | 10/2013 | Kukulski et al. |
| 2015/0251671 | A1 | 9/2015 | Iler |
| 2015/0307115 | A1 | 10/2015 | Wang et al. |
| 2017/0080956 | A1 | 3/2017 | James et al. |
| 2017/0166225 | A1 | 6/2017 | Schoedl et al. |
| 2017/0210398 | A1 | 7/2017 | Wilt et al. |
| 2017/0334469 | A1 | 11/2017 | Johnson et al. |
| 2018/0118235 | A1 | 5/2018 | Johnson et al. |
| 2019/0144015 | A1 | 5/2019 | Ring et al. |
| 2020/0385033 | A1* | 12/2020 | Schoedl ..... B61F 1/02 |

OTHER PUBLICATIONS

International Search Report and Written Opinion of corresponding PCT application No. PCT/US19/66441 dated Feb. 14, 2020.

* cited by examiner

SELECTIVE CUSHION UNIT YOKE WITH INTEGRAL DRAFT GEAR HOUSING

BACKGROUND OF THE INVENTION

In a conventional frictional draft gear, one or more elastic elements, such as a coil spring or a set of elastomeric pads, is enclosed in a housing mounted in the yoke behind the coupler of a railway car. A piston or friction clutch received in the housing absorbs loads transmitted via a coupler follower which moves relative to the yoke in response to buff and draft loads applied on the coupler, and the draft gear is compressed in the yoke to absorb energy of the buff and draft forces. The basic draft gear apparatus has been used for decades and the fundamental details would be known to those of ordinary skill in the art. However, in many cases unacceptably large forces are transmitted to the railway car and there is a need in the art for a cushioning apparatus that dissipates more force during impact than the conventional draft gear. U.S. Pat. Nos. 3,202,300 and 10,328,957 are incorporated by reference herein for their teaching of conventional draft gear functioning and measurement of energy absorption, but many other patents and publications describe the functioning of a draft gear.

U.S. Pat. No. 5,487,480 is incorporated by reference herein for its description of a hydraulic end-of-car cushioning (EOCC) unit. A hydraulic cushioning unit comprises a piston received in a cylinder filled with fluid. Such devices may dissipate more energy than a conventional draft gear, but they are known to be prone to leakage, and a conventional hydraulic unit provides minimal cushioning of draft forces on the coupler. Many other patents and publications describe the functioning of a hydraulic unit Selective cushioning apparatuses are described in U.S. Pat. Nos. 10,308,263 and 10,513,275 by the inventors herein. These patents are incorporated by reference in their entirety. The selective cushioning apparatuses are characterized by a stack of "elastomeric units" which consist of one or more elastomeric pads arranged on a rigid metal plate. The elastomeric units are arranged into stacks which may be positioned within the yoke, absorbing buff and draft loads on the coupler, like a conventional draft gear, and/or behind the yoke, dissipating additional energy from buff loads on the coupler. The selective cushioning apparatus is a versatile design capable of dissipating large amounts of energy and capable of being installed in a variety of pre-existing sill configurations.

SUMMARY OF THE INVENTION

In one aspect, it is desired to increase the applications for selective cushioning apparatuses so that the units can fit into a sill having forward, intermediate and rear lugs designed to accommodate a hydraulic cushioning unit, without having to reconfigure the sill.

In another aspect, it is desired to adapt the selective cushioning unit for use with a draft gear so that the combined unit fits into different pre-existing sill pocket configurations.

Thus, in a first aspect, the invention is an end-of-car cushioning apparatus for a railway car adapted to be received in a sill having longitudinal, lateral and vertical dimensions, and rear, front, and intermediate lugs, said intermediate lugs being positioned in the sill longitudinally between the rear lugs and the front lugs, the cushioning apparatus comprising: a yoke adapted to be received in the sill and having an open nose at one end adapted to receive a coupler, a tail comprising a transverse tail wall at an end opposite the nose, opposed walls extending from the tail wall to the nose, and an inside area between the opposed walls defined by a housing integral with the yoke; a coupler follower member adapted to receive buff force from the coupler and adapted to move inside the yoke, wherein longitudinal travel of the coupler follower in buff and draft directions is limited by contact between the integral housing and the coupler follower; at least one elastic element positioned within and aligned by the housing integral with the yoke; and a stack of elastomeric units positioned behind the transverse tail wall of the yoke, each elastomeric unit comprising at least one elastomeric pad on a metal plate.

The yoke used with a selective cushioning unit may be shorter than a conventional yoke to accommodate a stack of elastomeric units behind the yoke and in embodiments, the transverse tail wall of the yoke is sized to fit laterally between the intermediate lugs on the sill that would conventionally delimit the part of the pocket receiving the cylinder portion of a hydraulic unit. The nose of the yoke may be sized to fit laterally between the front lugs of a sill adapted to house a conventional hydraulic draft gear. In embodiments, the coupler receiving member abuts forward stops on an internal surface of the sill in a draft position; and the longitudinal distance between the forward stops and rear stops is about 38¾ inches or about 48¾ inches, which are "EOC-9" and "EOC-10" pocket dimensions, as discussed below.

In a second aspect, the invention is embodied as an end-of-car cushioning apparatus for a railway car adapted to be received in a sill having longitudinal, lateral and vertical dimensions, and rear, front, and intermediate lugs, said intermediate lugs being positioned in the sill longitudinally between the rear lugs and the front lugs, the cushioning apparatus comprising: a yoke adapted to be received in the sill and having an open nose at one end adapted to receive a coupler, a tail comprising a transverse tail wall at an end opposite the nose, and opposed walls extending from the tail wall to the nose; a draft gear, separate from the yoke, comprising an outer housing, a friction clutch or piston received in the outer housing, and an elastic element in the outer housing, clearance being provided between the yoke and the outer housing. The friction clutch or piston bears on the elastic element when buff and draft forces are applied to the coupler. A coupler follower member, adapted to receive buff force from the coupler and adapted to move inside the yoke, bears on the piston or friction clutch of the draft gear, such that longitudinal travel in buff and draft directions is limited by contact of the coupler follower with the draft gear outer housing. The outer housing of the draft gear is received between the intermediate lugs in the sill and bears against the transverse tail wall of the yoke. A stack of elastomeric units is positioned behind the transverse tail wall of the yoke, each elastomeric unit comprising at least one elastomeric pad on a metal plate.

In embodiments, the total travel of the coupler follower to the front of integral housing or the front of the separate draft gear housing may be about 3¼ inches whether a separate draft gear or an integral housing is employed. For example between about 2 inches to about 3¼ inches of travel may be provided for. The maximum represents the total travel achieved with a conventional draft gear. A separate draft gear according to embodiments of the invention differs from draft gears of the prior art in that flange-like stops at the base of the draft gear, which in prior art draft gears engage the draft lugs, are eliminated.

In another aspect of the invention, the shortened yoke is employed with a "buff gear" behind the yoke to absorb energy from buff loads on the coupler. In this aspect, the invention is embodied as an end-of-car cushioning apparatus for a railway car adapted to be received in a sill having longitudinal, lateral and vertical dimensions, and rear, front, and intermediate lugs, said intermediate lugs being positioned in the sill longitudinally between the rear lugs and the front lugs. The cushioning apparatus comprises: a yoke adapted to be received in the sill and having an open nose at one end adapted to receive a coupler, a tail comprising a transverse tail wall at an end opposite the nose, opposed walls extending from the tail wall to the nose, and an inside area between the opposed walls. A first elastic element is positioned in the inside area between the opposed walls and the transverse tail wall is adapted to be received between intermediate lugs in the sill. A coupler follower member is adapted to receive buff force from the coupler and move inside the yoke, such that longitudinal travel in buff direction is limited by full compression of the elastic element (either a draft gear or a stack of plates with elastomeric pads). A buff gear is positioned behind the transverse tail wall of the yoke. The buff gear comprises an outer housing, a friction clutch or piston received in the outer housing, and a set of elastomeric pads or a spring in the outer housing, the friction clutch or piston bearing on the set of elastomeric pads or spring when buff forces are applied to the coupler.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
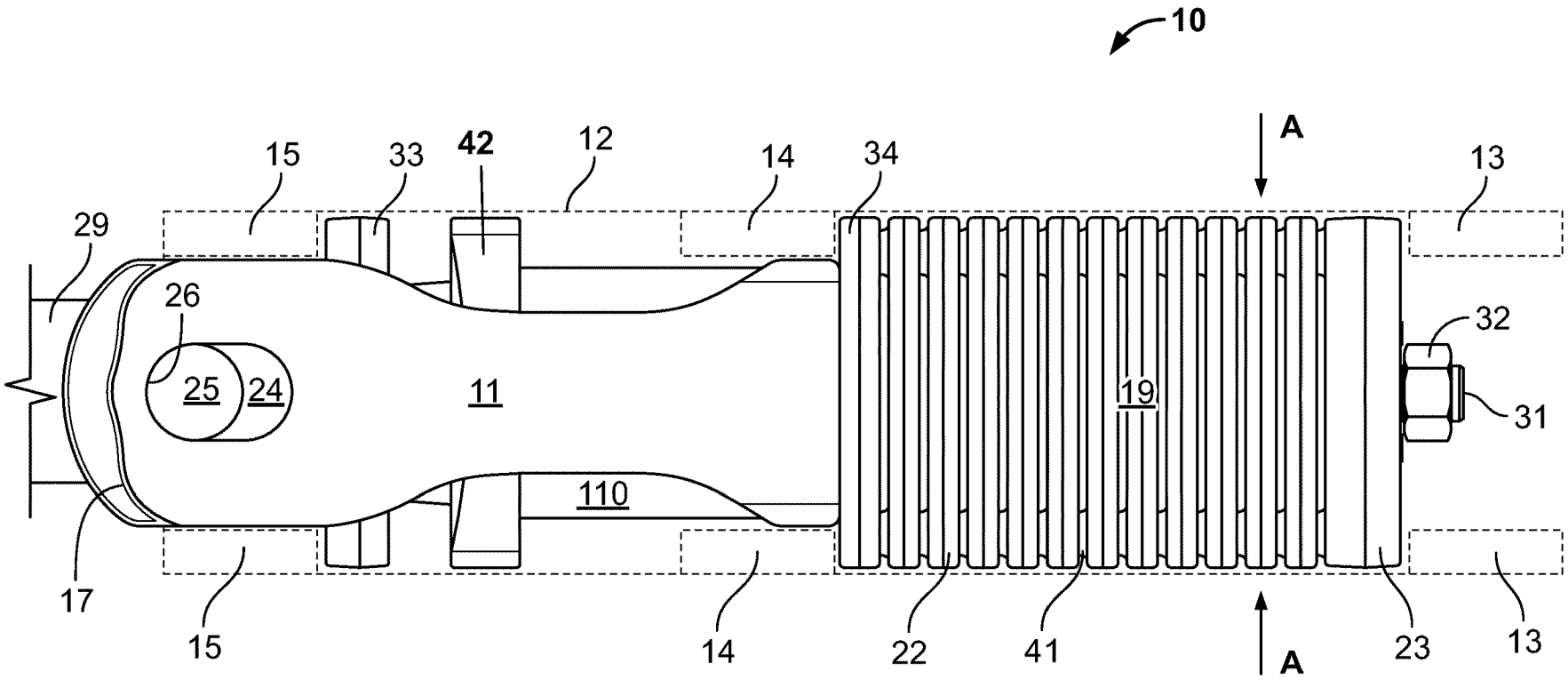
FIG. 1 is a top view of a selective cushioning unit according to an embodiment of the invention.

The drawings are schematic and may not be to scale and features not necessary for an understanding of the invention are not shown.

DETAILED DESCRIPTION OF THE INVENTION

Directions and orientations herein refer to the normal orientation of a railway car in use. Thus, unless the context clearly requires otherwise, the "front" of an element is in a direction away from the body of the car and "rear" is in the opposite direction, from the front end of the coupler toward the car body. Likewise, the "longitudinal" axis or direction is parallel to the rails and in the direction of movement of the railway car on the track in either direction. The "transverse" or "lateral" axis or direction is perpendicular to the longitudinal axis and perpendicular to the rail. A "transverse plane" or "vertical cross section" is a plane perpendicular to the longitudinal axis of the sill. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the surface the train travels on.

"Buff force" on the coupler means force applied when the coupler is urged in the inboard direction of the railway car, as when two railway cars impact one another. "Buff travel" the "buff direction" and "in buff" refers to displacement of any element of the cushioning unit in response to buff force. "Draft" is opposite to buff force and is applied to a coupler when a locomotive pulls on a railway car train, for example. The "draft direction" and "in draft" are used to describe positions and movement of the selective cushioning unit and elements of the cushioning unit when draft forces are applied to the coupler. "Neutral" refers to the position of components before buff or draft forces are applied. Some elements and components of the invention, including the elastomeric pads, may be pre-stressed and pre-biased in the neutral condition.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives. Thermoplastic copolyesters used in some conventional draft gear may be used in the stacks of elastomeric units according to the invention.

As used herein, the term "about" associated with a numerical value is understood to indicate the numerical value as closely as possible, allowing for a margin of +/−20% of the value. With reference to specific standards, given dimensions vary at least within tolerances accepted in the railroad industry.

"Travel" refers to a distance traveled by the coupler follower upon impact and may also be referred to as "displacement". In some instances, clear from the context, "travel" refers to the full possible extent of movement, i.e., when the pads are fully compressed.

A person having ordinary skill in the art has a general knowledge of standards and procedures established by the Association of American Railroads ("AAR") and the published AAR standards cited herein are incorporated by reference as background. Reference herein to AAR standards refers to standards in effect on the filing date of this application. In embodiments, a cushioning apparatus according to the invention fits between front and rear stops of an "EOC-9" dimensions of about 38¾ inches described in AAR standard S-183 or EOC-10 pocket with a pocket length of about 48¾ inches described in AAR standard S-184. In other embodiments, the cushioning device may be adapted to fit other AAR standard or non-standard pocket dimensions depending on the application.

A selective cushioning unit according to the invention comprises a draft gear and may employ two draft gears. A "draft gear" as used herein is an element comprising an outer housing, a friction clutch or piston received in the outer housing, and an elastic element within the housing that the friction clutch or piston bears upon when force is applied on the coupler. The elastic element may be a spring or a stack of elastomeric pads. In embodiments according to the invention, a draft gear is integral with the yoke, meaning that the housing and the yoke form one piece and the elastic element is arranged inside the integral housing. In other embodiments, a separate draft gear, i.e., having a housing separate from the yoke, is adapted to fit against the forward side of the transverse tail wall of the yoke and sized to fit between intermediate lugs of a pocket designed for a hydraulic unit. In still other embodiments of the invention a "buff gear" is employed behind the yoke—called a "buff gear" because it absorbs buff loads when the transverse tail wall of the yoke bears on the piston or friction clutch.

FIG. 1 shows a top view of a selective cushioning unit 10 according to an embodiment of the invention including yoke 11 adapted to be received in sill 12, shown in outline, including rear lugs 13, intermediate lugs 14 and front lugs 15. In the embodiment shown, yoke 11 includes transverse tail wall 16 received between intermediate lugs 14 and a nose 17 received between front lugs 15. A stack 19 of elastomeric units 22 is positioned behind tail wall 16. In embodiments, stack 19 of elastomeric units comprises a plurality of substantially identical rigid metal plates, each having an elastomeric pad between adjacent plates, assembled between front plate 34 and rear plate 23.

A plate and a pad together are called an "elastomeric unit". In embodiments, mechanical stops may be provided on the metal plates to prevent overcompression of elastomeric pads when stack 19 is compressed in response to buff loads. At a predetermined amount of force, metal-on-metal contact is reached so that further deformation of the elastomeric pad is prevented. In embodiments, protrusions on one metal plate may mate with recesses on an adjacent plate at a predetermined amount of travel, so that adjacent plates in a stack are adapted to form a nested arrangement. Metal-to-metal contact on the stop surfaces occurs when an elastomeric pad between two adjacent plates is compressed a predetermined amount, such as 20-80%, and in embodiments 20-60%, of the uncompressed thickness of the pads. In embodiments, the pads in stack 19 compress about 0.5 inches (from their uncompressed thickness prior to installation) before metal to metal contact prevents further compression. In embodiments, the elastomeric pads are prestressed on installation. In embodiments, a protrusion on an elastomeric pad mates with a feature on an adjacent rigid plate to align the elastomeric units.

Figure 5:
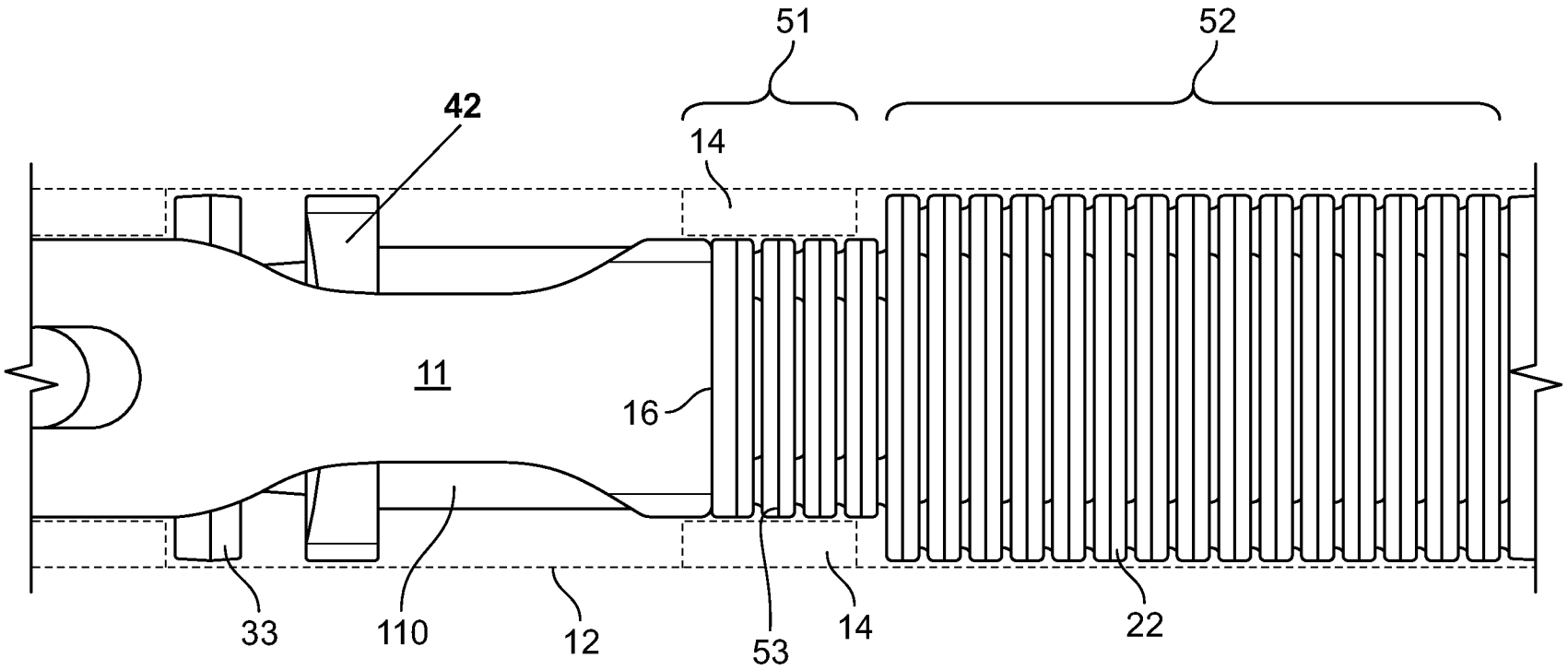
FIG. 5 is a side view of a selective cushioning apparatus according to an embodiment of the invention having two different stacks of elastomeric units behind the yoke.

A cushioning unit according to the invention is selective in that the amount of travel can be selected based on the number of substantially identical elastomeric units included in a stack. In FIG. 5, the stack may be formed as a combination of a stack 51, having smaller plates and corresponding pads fitting between stops 14, and larger stack 52, comprised of plate/pad combinations behind stack 51. This approach may be employed if the pocket is longer.

Figure 4:
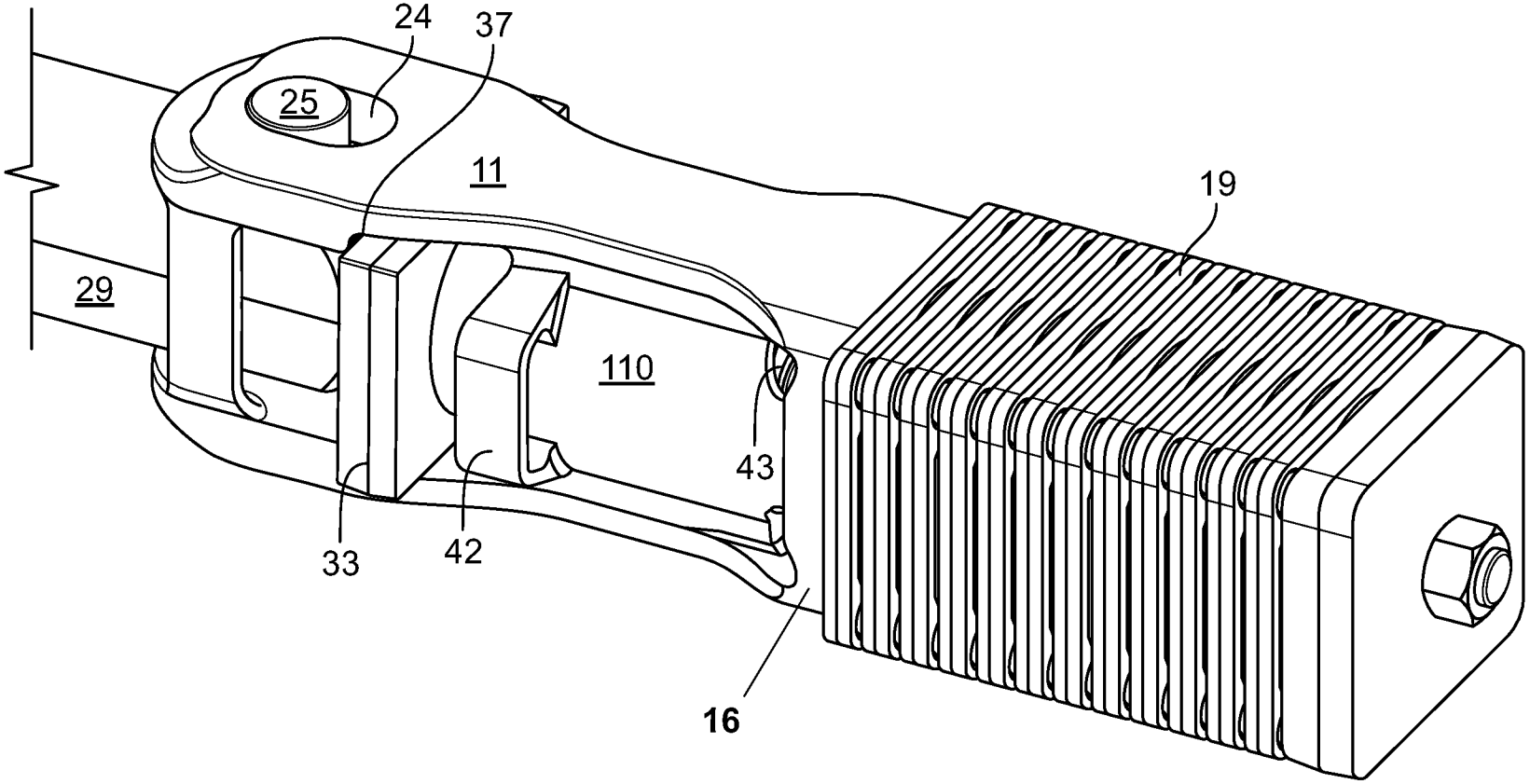
FIG. 4 is a perspective view of a selective cushioning unit according to an embodiment of the invention.

The perspective view of FIG. 4 shows an integral housing 110 with a portion 42 at the front end 36 of integral housing 110 which limits movement of coupler follower 33. When coupler 29 is forced inboard, referred to as the "buff position", travel of coupler follower 33 is limited by front end 36 of integral housing 110, including portion 42. In the "draft position", when coupler 29 is pulled away from the car body, elastic elements 39 in the draft gear are compressed (elastic elements 39 are partially visible in FIG. 4 through recess 43 in integral housing 110 and near the tail wall 16), and portion 42 of integral housing 110, contacts coupler follower 33, which in turn contacts forward stop feature 37 on nose 17 of yoke 11.

In the embodiment shown, nose 17 of yoke 11 has vertically aligned holes 24 adapted to receive coupler pin 25. The vertically aligned holes 24 are larger in a longitudinal dimension than coupler pin 25. As shown in FIG. 1, forward end 26 of aligned holes 25 bears against coupler pin 25 when a draft load is applied on the coupler 29 and pin 25 moves toward the opposite end of elongated hole 24 when a sufficient buff load is applied on the coupler. The additional space is required around coupler pin 25 to allow for travel of the shortened yoke. In other embodiments, similar to an "E-type" arrangement, opposed walls 21 may be on opposed horizontal sides of the yoke, and the coupler may be attached to the coupler with a horizontally oriented draft key.

Sill 12 has a lateral dimension shown by arrows "A" in FIG. 1. Metal plates 22 in stack 19 of elastomeric units have a lateral dimension within about ⅛ inch of the lateral dimension A of sill 12, which may serve to align the elastomeric units in the sill. The reduced width of tail wall 16 compared to the set of elastomeric pads 19 is illustrated in FIG. 4.

Elastomeric units 22 may be joined together by at least one rod 31 passing through a hole in each of the plates. In the embodiment shown, elastomeric units 22 are held together between plates 34 and 23, by a rod 31 passing through the plates 22, 23, and 34 and secured by fastener 32. In embodiments, stack 19 is shaped to fit flush against the transverse tail wall of the yoke without being mechanically attached to the yoke. In the embodiment shown, rear plate 23 abuts rear lugs 13. In a draft position, coupler follower 33 abuts front lugs 15. In embodiments, a cushioning apparatus according to the invention fits between front and rear stops of an "EOC-9" standard pocket dimensions of about 38¾ inches described in AAR standard S-183 or "EOC-10" standard pocket with a pocket length of about 48¾ inches described in AAR standard S-184.

Figure 2:
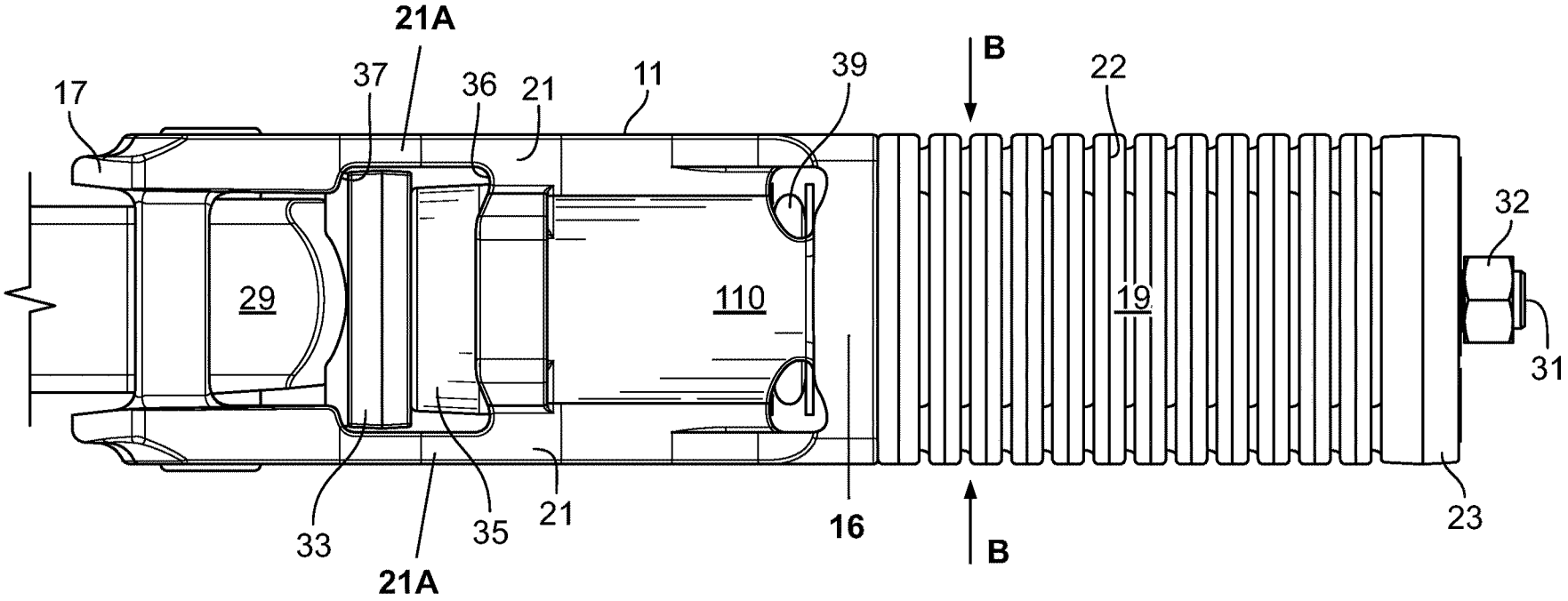
FIG. 2 is a side view of the selective cushioning unit of FIG. 1.
Figure 3:
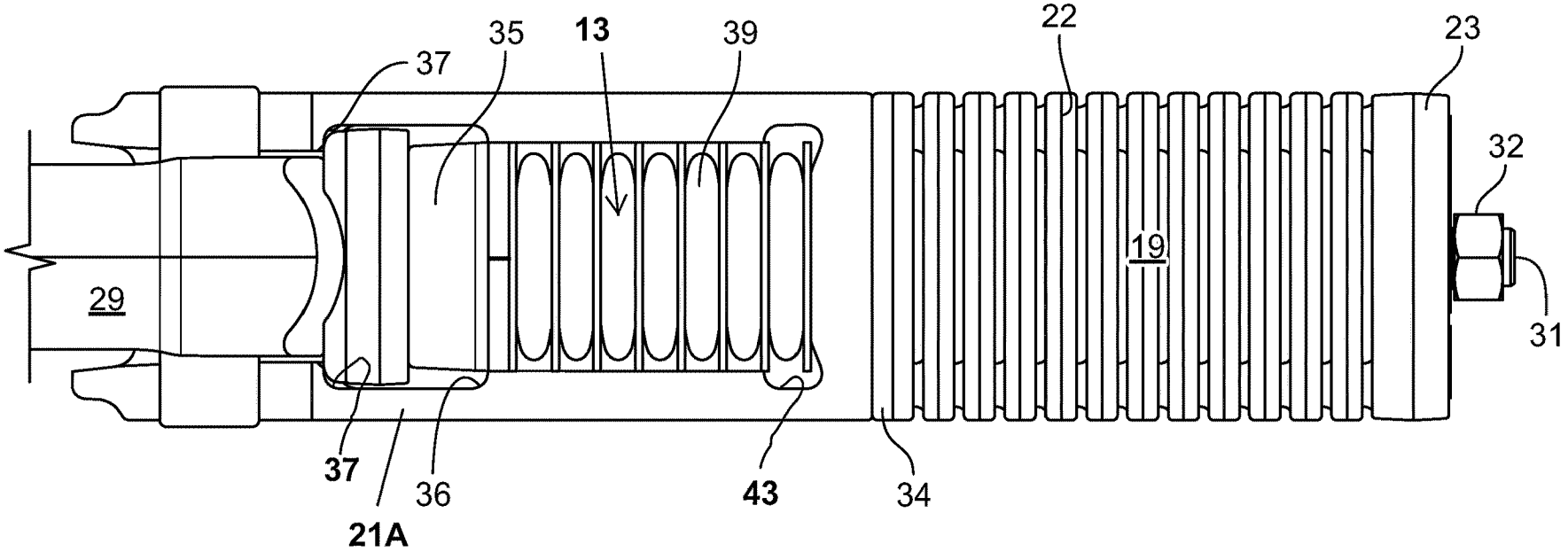
FIG. 3 is a cutaway view of the selective cushioning unit in FIG. 2.

FIG. 2 is a side view of the assembly of FIG. 1, showing yoke 11 having opposed walls 21 extending from tail wall 16 to nose 17 with a space between opposed walls 21 accommodating integral housing 110, which connects opposed walls 21. The integral housing 110 defines, in a combination with opposed walls 21 and the tail wall 16, an inside area of the yoke 11. Each wall 21 has a portion 21A adjacent the nose 17. The portion 21 has a reduced thickness as compared to the remaining portion of the wall 21 to define a front end 36 of the housing 110 and the forward stop feature 37. In this embodiment, yoke 11 and housing 110 are formed as one piece, such as by a metal casting process. Integral housing 110 serves to align pads 39 in the inner area of the yoke so that a draft gear-like arrangement within the yoke does not require assembly of a separate draft gear housing. In the embodiment of FIG. 2, transverse tail wall 16 of yoke 11 has substantially the same vertical dimension B as the sill but is narrower in the lateral dimension to accommodate stops 14, while both vertical and lateral dimensions of the elastomeric units 22 may correspond to the dimensions of the sill (allowing a small gap, with about ⅛ inch, for travel). Friction clutch or piston 35 is moved inboard by coupler follower 33 when coupler 29 moves inboard, as in the event of an impact of two train cars. Travel of coupler follower 33 is delimited by front end 36 of integral housing 110. In the draft position, with the piston or friction clutch fully compressed, front end 36 of the integral housing 110 contacts coupler follower 33, which presses against forward stop feature 37 on the yoke 11. As noted above, total travel for the coupler follower may be in a range of about 2 to about 3¼ inches.

Sill 12 may have a nominal width of about 12 to 13 inches, for example 12.875 inches. Stops 13, 14, 15 may protrude about 0.5 to 2.0 inches from opposed inside surfaces of the sill, for example 1.5 inches on either side of the sill. Thus, the tail is designed to have a width reduced by about 1.0 inch to about 4.0 inches to fit between stops 14. For example, the yoke 11 may have a transverse tail wall 16 with a width of about 9 to about 10 inches.

Figure 7:
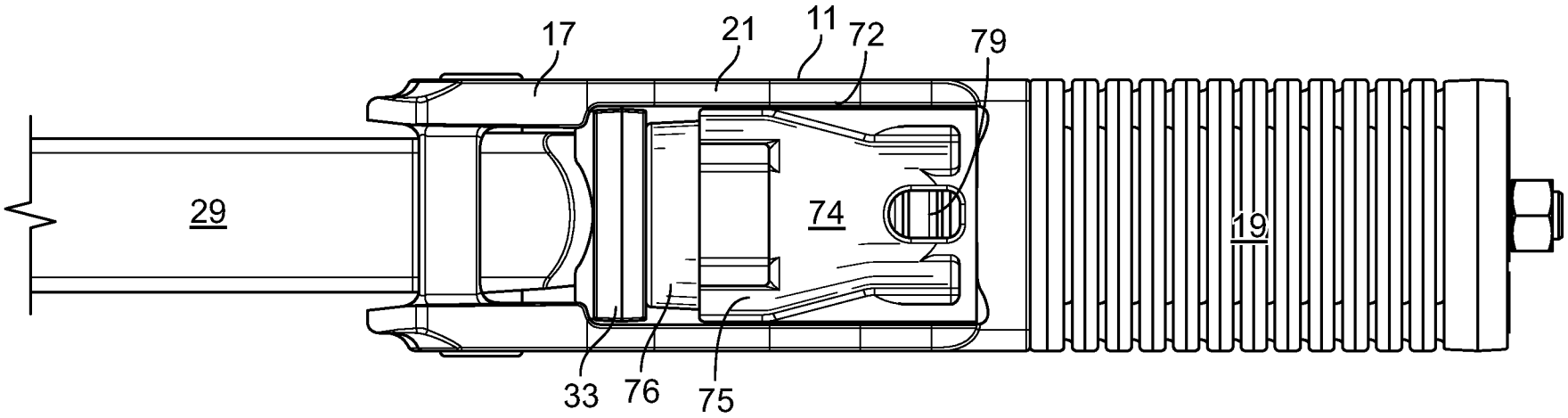
FIG. 7 depicts a side view of a selective cushioning apparatus according to an embodiment of the invention having a separate draft gear inside the modified yoke.

In an embodiment depicted in FIG. 7, a draft gear 74 is provided separate from the yoke, so that clearance 72 is provided between the yoke and the draft gear. In this embodiment, draft gear 74 comprises an outer housing 75, a friction clutch or piston 76 received in outer housing 75, and an elastic element 79 in the housing. In the embodiment shown, the flange like base of a conventional draft gear, which would conventionally rest on the draft lugs, is omitted so that the draft gear may fit in modified yoke 11 and between intermediate stops 14.

Figure 6:
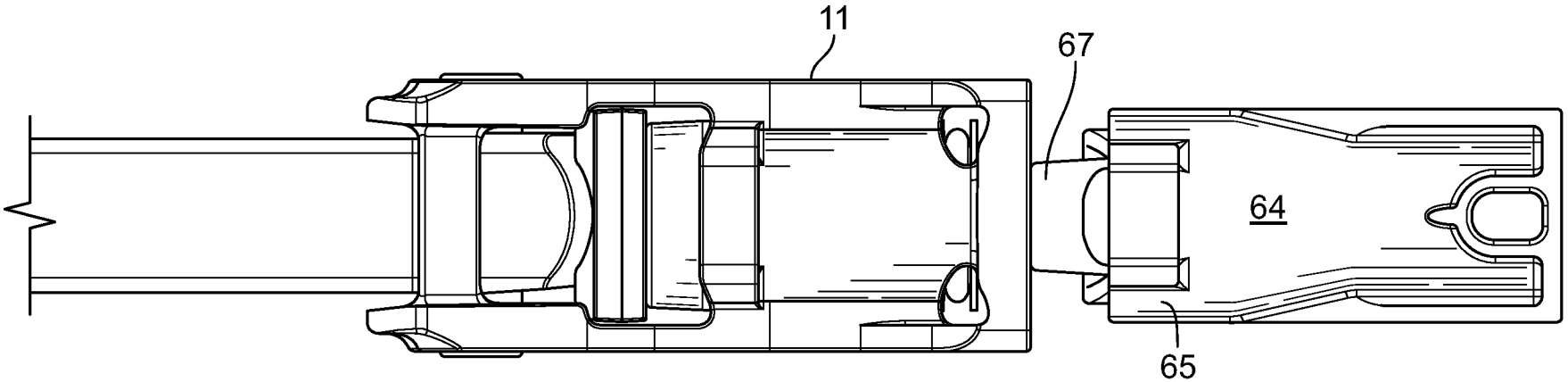
FIG. 6 is a side view of a selective cushioning apparatus according to an embodiment of the invention having a buff gear behind the yoke.

In an embodiment shown in FIG. 6, buff gear 64 may be provided behind shortened yoke 11, substituting for a stack of elastomeric units. The buff gear comprises outer housing 65, a friction clutch or piston 67 received in outer housing 65, and a second elastic element in the housing. The friction clutch or piston 67 bears on the elastic element when buff forces are applied to the coupler and the yoke is forced inboard. Buff gear 64 may also be designed with a narrow portion to fit between the intermediate lugs.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

What is claimed is:

1. An end-of-car cushioning apparatus for a railway car adapted to be received in a sill having longitudinal, lateral and vertical dimensions, and rear lugs, front lugs, and intermediate lugs, the intermediate lugs being positioned in the sill longitudinally between the rear lugs and the front lugs, the end-of-car cushioning apparatus comprising:

a yoke adapted to be received in the sill, the yoke comprising: an open nose at one end, the open nose adapted to receive a coupler, a tail comprising a transverse tail wall at an end opposite the open nose, opposed walls extending from the transverse tail wall to the open nose;

a housing connecting the opposed walls along a length of the housing, the housing being formed integral with the yoke and defining, in a combination with the opposed walls and the transverse tail wall, an inside area of the yoke;

a coupler follower adapted to receive buff force from the coupler and adapted to move inside the yoke, wherein longitudinal travel of the coupler follower in buff and draft directions is limited by contact of the coupler follower with a front end of the housing; and an elastic element positioned within the inside area.

2. The end-of-car cushioning apparatus according to claim 1, wherein total travel of the coupler follower is about 2 to about 3¼ inches.

3. The end-of-car cushioning apparatus according to claim 1, wherein the transverse tail wall of the yoke is sized to fit laterally between the intermediate lugs on the sill.

4. The end-of-car cushioning apparatus according to claim 1, wherein the open nose of the yoke is sized to fit laterally between the front lugs on the sill.

5. The end-of-car cushioning apparatus according to claim 1, wherein the open nose has vertically aligned holes adapted to receive a coupler pin, said vertically aligned holes being larger in a longitudinal dimension than a diameter of the coupler pin.

6. The end-of-car cushioning apparatus according to claim 1, wherein the opposed walls have horizontally aligned slots adapted to receive a draft key.

7. The end-of-car cushioning apparatus according to claim 1, further comprising:

a stack of elastomeric units positioned behind the transverse tail wall of the yoke, each elastomeric unit comprising an elastomeric pad on a metal plate;

metal plates in the stack of elastomeric units have vertical and lateral dimensions within about ⅛ inch of respective vertical and lateral dimensions of the sill;

all of the metal plates in the stack of elastomeric units are joined together by at least one rod passing through a hole in each metal plate.

8. The end-of-car cushioning apparatus according to claim 7, wherein the metal plates in the stack of elastomeric units are provided in two sizes, a first size adapted to fit between the intermediate lugs and a second size adapted to substantially fill a cross section of the sill.

9. The end-of-car cushioning apparatus according to claim 7, wherein a first end of the stack of elastomeric units configured to abut the rear lugs in the sill; wherein the coupler follower configured to abut front lugs on an internal surface of the sill in a draft position; and wherein a longitudinal distance between the front lugs and rear lugs being about 38¾ inches or about 48¾ inches.

10. The end-of-car cushioning apparatus according to claim 7, wherein the each metal plate in the stack of elastomeric units comprises stop surfaces adapted to contact an adjacent metal plate at a predetermined amount of compression of the elastomeric pad between adjacent metal plates.

11. The end-of-car cushioning apparatus according to claim 10, further comprising front and rear plates bounding the stack of elastomeric units and a rod passing through the front and rear plates to hold the stack of elastomeric units together, said stack of elastomeric units mounting flush against the transverse tail wall of the yoke without being mechanically attached to the yoke.

12. The end-of-car cushioning apparatus according to claim 1, further comprising a friction clutch or piston received in the housing.

13. The end-of-car cushioning apparatus according to claim 1, further comprising a stack of elastomeric units positioned behind the transverse tail wall of the yoke, each elastomeric unit comprising at least one elastomeric pad on a metal plate; wherein metal plates in the stack of elastomeric units have vertical and lateral dimensions within about ⅛ inch of respective vertical and lateral dimensions of the sill, filling a cross section of the sill; and wherein all of the metal plates in the stack of elastomeric units are joined together by at least one rod passing through a hole in each of the metal plates.

14. The end-of-car cushioning apparatus according to claim 1, further comprising a stack of elastomeric units positioned behind the transverse tail wall of the yoke, each elastomeric unit comprising at least one elastomeric pad on a metal plate; wherein a first end of the stack of elastomeric units abuts the rear lugs in the sill; wherein the coupler follower abuts forward stops on an internal surface of the sill in a draft position; and wherein a longitudinal distance between the front lugs and rear lugs is about 38¾ inches or about 48¾ inches.

15. The end-of-car cushioning apparatus according to claim 1, further comprising a stack of elastomeric units positioned behind the transverse tail wall of the yoke, each elastomeric unit comprising at least one elastomeric pad on a metal plate, wherein metal plates in the stack of elastomeric units are provided with stop surfaces so that each metal plate being adapted to contact an adjacent plate at a predetermined amount of compression of the at least one elastomeric pad between adjacent metal plates.

16. The end-of-car cushioning apparatus according to claim 15, further comprising front and rear plates bounding the stack of elastomeric units and a rod passing through the front and rear plates to hold the stack of elastomeric units together, the stack of elastomeric units mountable flush against the transverse tail wall of the yoke without being mechanically attached to the yoke.

17. The end-of-car cushioning apparatus according to claim 1, further comprising a buff gear positioned behind the transverse tail wall of the yoke, the buff gear comprising an outer housing, a friction clutch or piston received in the outer housing, and another elastic element in the housing, the friction clutch or piston bearing on the another elastic element when buff forces are applied to the coupler.

18. An end-of-car cushioning apparatus for a railway car, the end-of-car cushioning apparatus adapted to be received in a sill having longitudinal, lateral and vertical dimensions, and rear lugs, front lugs, and intermediate lugs, the intermediate lugs being positioned in the sill longitudinally between the rear lugs and the front lugs, the end-of-car cushioning apparatus comprising:

a yoke adapted to be received in the sill and having an open nose at one end adapted to receive a coupler, a tail comprising a transverse tail wall at an end opposite the open nose, and opposed walls extending from the transverse tail wall to the open nose;

a coupler follower adapted to receive buff force from the coupler and adapted to move inside the yoke;

a draft gear disposed inside the yoke between the coupler follower and the transverse tail wall, clearance being provided between the opposed walls and the draft gear, the draft gear comprising a housing, a friction clutch or piston received in the housing, and an elastic element in the housing in a contact with the friction clutch or piston; and a stack of elastomeric units positioned behind the transverse tail wall of the yoke, each elastomeric unit comprising at least one elastomeric pad on a metal plate, wherein metal plates in the stack of elastomeric units have vertical and lateral dimensions within about ⅛ inch of respective vertical and lateral dimensions of the sill, filling a cross section of the sill, and wherein all of the metal plates in the stack of elastomeric units are joined together by at least one rod passing through a hole in each of the metal plates;

the coupler follower bearing on the friction clutch or the piston of the draft gear, wherein longitudinal travel in buff and draft directions is limited by a contact of the housing of the draft gear and the coupler follower.

19. The end-of-car cushioning apparatus according to claim 18, wherein a total longitudinal travel of the coupler follower is about 2 to about 3¼ inches.

20. The end-of-car cushioning apparatus according to claim 18, wherein the open nose of the yoke is sized to fit laterally between the front lugs on the sill.

21. The end-of-car cushioning apparatus according to claim 18, wherein the open nose has vertically aligned holes adapted to receive a coupler pin, said vertically aligned holes being larger in a longitudinal dimension than a coupler pin.

22. The end-of-car cushioning apparatus according to claim 18, wherein opposed side walls have horizontally aligned slots adapted to receive a draft key.

23. The end-of-car cushioning apparatus according to claim 18, wherein the housing of the draft gear is configured to be received between the intermediate lugs in the sill.

24. A railway car yoke, comprising:

an open nose at one end, the open nose adapted to receive a coupler therethrough;

a tail comprising a tail wall at an end opposite the open nose;

opposed walls extending from the tail wall to the open nose; and a housing connecting the opposed walls along a length of the housing, the housing being formed integral with the railway car yoke and defining, in a combination with the opposed walls and the tail wall, an inside area of the railway car yoke.

25. The railway car yoke according to claim 24, wherein the tail wall of the railway car yoke being sized to fit laterally between intermediate lugs on a railway car sill.

26. The railway car yoke according to claim 24, wherein the open nose of the railway car yoke comprises vertically aligned elongated holes adapted to receive a coupler pin, the vertically aligned elongated holes being larger in a longitudinal dimension than a diameter of the coupler pin.

27. The railway car yoke according to claim 24, further comprising a portion on the housing adjacent the one end of the housing, the portion configured to limit travel of a coupler follower.

28. A railway car yoke, comprising:

an open nose at a front end, the open nose adapted to receive a coupler therethrough;

a tail comprising a tail wall at an end opposite the front end;

opposed walls extending from the tail wall to the open nose;

a housing connecting the opposed walls, the housing being formed integral with the railway car yoke and defining an inside area of the railway car yoke; and a portion on the housing adjacent the front end of the housing;

the front end and the portion configured to limit travel of a coupler follower adapted to move within the inside area of the railway car yoke.

29. An end-of-car cushioning apparatus for a railway car, the end-of-car cushioning apparatus adapted to be received in a sill having longitudinal, lateral and vertical dimensions, and rear lugs, front lugs, and intermediate lugs, the intermediate lugs being positioned in the sill longitudinally between the rear lugs and the front lugs, the end-of-car cushioning apparatus comprising:

a yoke adapted to be received in the sill and having an open nose at one end adapted to receive a coupler, a tail comprising a transverse tail wall at an end opposite the open nose, and opposed walls extending from the transverse tail wall to the open nose;

a coupler follower adapted to receive buff force from the coupler and adapted to move inside the yoke;

a draft gear disposed inside the yoke between the coupler follower and the transverse tail wall, clearance being provided between the opposed walls and the draft gear, the draft gear comprising a housing, a friction clutch or piston received in the housing, and an elastic element in the housing in a contact with the friction clutch or piston; and a stack of elastomeric units positioned behind the transverse tail wall of the yoke, each elastomeric unit comprising at least one elastomeric pad on a metal plate, wherein a first end of the stack of elastomeric units abuts the rear lugs in the sill, wherein the coupler follower abuts forward stops on an internal surface of the sill in a draft position, and wherein a longitudinal distance between the front lugs and rear lugs is about 38¾ inches or about 48¾ inches;

the coupler follower bearing on the friction clutch or the piston of the draft gear, wherein longitudinal travel in buff and draft directions is limited by a contact of the housing of the draft gear and the coupler follower.

30. An end-of-car cushioning apparatus for a railway car, the end-of-car cushioning apparatus adapted to be received in a sill having longitudinal, lateral and vertical dimensions, and rear lugs, front lugs, and intermediate lugs, the intermediate lugs being positioned in the sill longitudinally between the rear lugs and the front lugs, the end-of-car cushioning apparatus comprising:

a yoke adapted to be received in the sill and having an open nose at one end adapted to receive a coupler, a tail comprising a transverse tail wall at an end opposite the open nose, and opposed walls extending from the transverse tail wall to the open nose;

a coupler follower adapted to receive buff force from the coupler and adapted to move inside the yoke;

a draft gear disposed inside the yoke between the coupler follower and the transverse tail wall, clearance being provided between the opposed walls and the draft gear, the draft gear comprising a housing, a friction clutch or piston received in the housing, and an elastic element in the housing in a contact with the friction clutch or piston; and a stack of elastomeric units positioned behind the transverse tail wall of the yoke, each elastomeric unit comprising at least one elastomeric pad on a metal plate, wherein metal plates in the stack of elastomeric units are provided with stop surfaces so that each metal plate being adapted to contact an adjacent plate at a predetermined amount of compression of the at least one elastomeric pad between adjacent metal plates;

the coupler follower bearing on the friction clutch or the piston of the draft gear, wherein longitudinal travel in buff and draft directions is limited by a contact of the housing of the draft gear and the coupler follower.

* * * * *